United States Patent [19]

Winebrenner

[11] 4,306,346

[45] Dec. 22, 1981

[54] TOOL FOR REMOVING A SPIN TUBE FROM A WASHING MACHINE

[76] Inventor: Donald L. Winebrenner, 4670 San Pablo Dam Rd., El Sobrante, Calif. 94803

[21] Appl. No.: 129,276

[22] Filed: Mar. 10, 1980

[51] Int. Cl.[3] ..... B25B 27/14

[52] U.S. Cl. ..... 29/275

[58] Field of Search ..... 29/275–277, 29/254–255, 280

[56] References Cited

U.S. PATENT DOCUMENTS 3,050,733 8/1962 Bach ..... 29/275 X
3,083,449 4/1963 Simmons ..... 29/275
3,099,079 7/1963 Stein ..... 29/275
3,209,445 10/1965 Moskovitz ..... 29/275

*Primary Examiner*—Robert C. Watson
*Attorney, Agent, or Firm*—Bielen and Peterson

[57] ABSTRACT

A tool for removing a washing machine spin tube including a first member having an end surface which contacts the end of the spin tube. A pair of recesses on the end portion of the first member accomodates a pair of ears on the spin tube. A second member connects to the first member and is adapted for insertion within the spin tube and for contacting a bearing mounted within the tube. The second member is sized such that the first and second members contact the spin tube and bearing at substantially the same time.

5 Claims, 4 Drawing Figures

TOOL FOR REMOVING A SPIN TUBE FROM A WASHING MACHINE

BACKGROUND OF THE INVENTION

The present invention relates to a novel tool for removing a washing machine spin tube.

Repair of automatic washers, particularly spent bearings, requires the removal of the spin tube and connected base assembly. The removal and recovery of the spin tube quickly and without damage thereto is the key step in this type of work.

In the past, spin tubes have invariably been damaged during washing machine repairs by the use of a hammer and other makeshift tools. In addition, a damaged spin tube requires the replacement of an expensive base assembly which is normally attached thereto. A tool for the removal of an automatic washing machine spin tube for recycling of the same is needed.

SUMMARY OF THE INVENTION

In accordance with the present invention a novel and useful tool for removing a washing machine spin tube is provided.

The tool of the present invention employs a first member which has a first and second end portion. The first end portion may be adapted to detachably connecting the same to a rod or extension member which is capable of transmitting force to the top of the spin tube. The second end portion of the first member includes an end surface for contacting the spin tube. The first member includes a pair of recesses on the second end portion which accomodates the pair of ears on the spin tube.

A second member, which may be integrally formed with the first member, is connected to the first member. The second member is adapted for insertion within the spin tube and has an end surface which contacts a bearing within the spin tube. The first member and second member are spaced such that the end surface of the second end portion of the first member and the end surface of the second member simultaneously contact the end of the spin tube in the internally mounted bearing, respectively. The second member may also have a flattened portion on the external surface for accomodating the pair of ears of the spin tube which extend to the pair of recesses found on the first member. Both the first and second members may be of cylindrical cross sectional configuration, but is not deemed to be limited to the same.

It may be apparent that a novel and useful tool has been described.

It is therefore an object of the present invention to provide a tool for removing a washing machine spin tube which does not damage the spin tube while removal of the same from a washing machine assembly.

It is another object of the present invention to provide a tool for removing a washing machine spin tube which permits the recycling of the spin tube after repair of other components found in the automatic washing machine.

It is yet another object of the present invention to provide a tool for removing a washing machine spin tube which is easily transportable and relatively inexpensive to manufacture.

The invention includes other objects and advantages especially as concerns particular characteristics and features thereof which will become apparent as the specification continues.

For a better understanding of the invention, reference is made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

Figure 1:
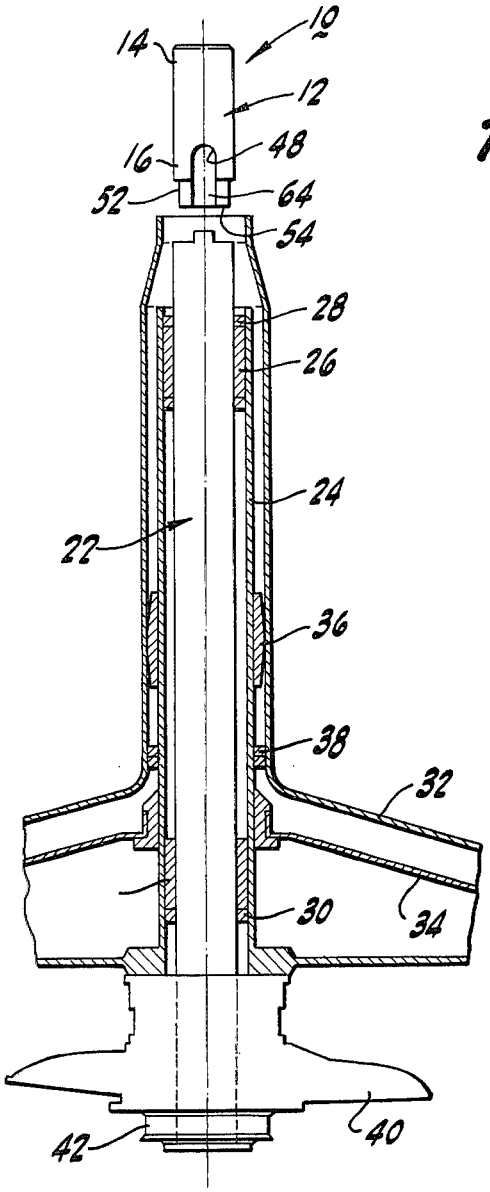
FIG. 1 is a broken sectional view of a washing machine assembly depicting the tool of the present invention as slightly exploded therefrom.
Figure 2:
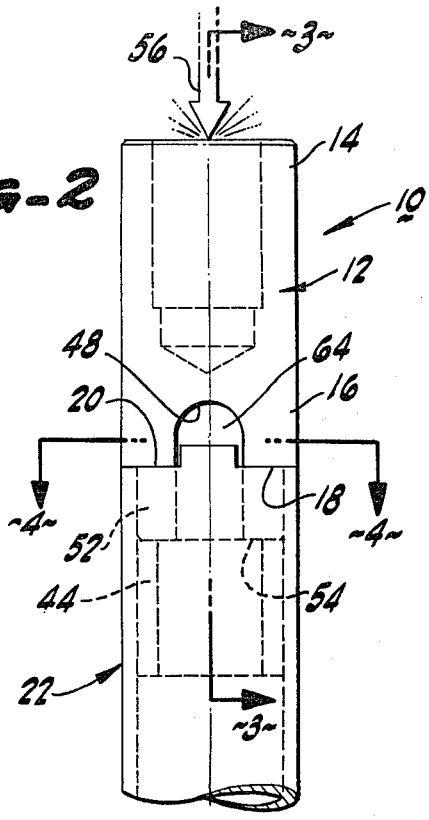
FIG. 2 is a broken side elevational view showing the tool of the present invention engaging the spin tube assembly.

With reference to the drawings, the invention as a whole is denoted by reference character 10 and includes as one of its elements a first member 12, FIGS. 1 and 2. With reference to FIG. 2, first member 12 has a first end portion 14 and a second end portion 16. Second end portion 16 includes an end surface 18 for contacting end surface 20 of spin tube 22.

Figure 4:
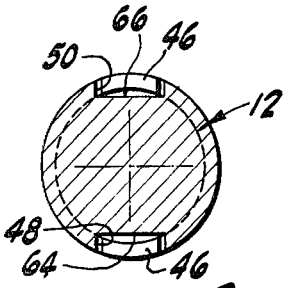
FIG. 4 is a sectional view taken along line 4—4 of FIG. 2.

Spin tube 22, FIG. 1, fits within centerpost 24 and is separated therefrom by bearings 26. Seals 28 and 30 protect bearings 26 against water incursion. Basket 32 overlies tub 34 (broken), within a washing machine. Basket bearings 36 separate centerpost 24 from basket 32. Again, seals 38 protect basket bearings 36 against water damage. Member 40 and pulley wheel 42 constitute a portion of the base plate assembly of the washing machine. Spin tube 22 connects to the same as shown. FIG. 1 represents the washing machine assembly after removal of the transmission shaft which normally fits within bearing 44 mounted internally on the inner surface of spin tube 22. Spin tube 22 includes a pair of ears 46, FIG. 4, which are intended for engaging basket 32 during the water extraction cycle of the automatic washing machine. Since the construction of the washing machine components heretofore described as known in the art, no further detail will be provided on the same.

Tool 10 also has a pair of recesses 48 and 50 on second end portion 14 which are intended for accomodating ears 46 of spin tube 22. As may be apparent from FIG. 2, ear 46 does not touch the sides of recess 48 and is therefore not damaged during the removal of spin tube 22 from the washing machine assembly.

Figure 3:
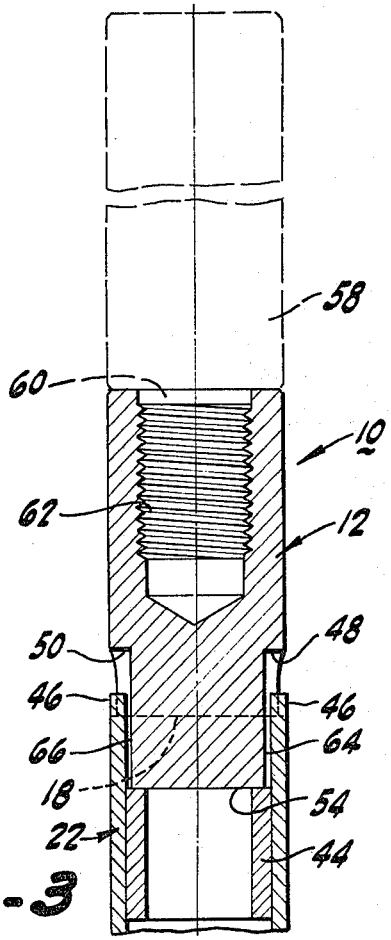
FIG. 3 is a slightly broken sectional view taken along line 3—3 of FIG. 2.

Tool 10 also includes a second member 52 which may be formed integrally with first member 12 as shown on the drawings, but may be connected to first member 12 by other methods such as welding, gluing, fastening, and the like. Second member 52 fits within spin tube 22 and has an end surface 54, FIG. 3, which is intended for contacting bearing 44. Second member 52 extends from first member 12 a selected distance such that contact occurs between end surface 54 and bearing 44 at the same time that end surface 18 of first member 12 contacts the end surface 20 of spin tube 22. Thus, any force on tool 10, depicted schematically by arrow 56 on FIG. 2, would be shared by surface 20 of spin tube 22 and bearing 44 therewithin. Tool 10 may also comprise a rod 58 having a threaded appendage 60 which threadingly engages internally threaded portion 62 of first member 12. Rod 58 is illustrated as broken since the embodiment shown in the drawings conceives of rod 50 as being substantially uniform throughout its length. Rod 58 and first member 12 may be quickly assembled and disassembled. First member 12, second member 52, and rod 58 may of substantially cylindrical configuration, although the dictates of the present invention are not intended to restrict these elements to this configuration. Second member 52 may also be formed with flattened portion 64 and 66 on the external surface thereof for accomodation of pair of ears 46 of spin tube 22, FIGS. 1 and 3.

In operation, the user of tool 10 places second member within spin tube 22 such that surface 54 rests on bearing 44. Substantially simultaneously with placement of second member 52, end surface 18 of first member 22 will contact surface 20 of spin tube 22. Ears 46 will fit along the flattened portion 64 and 66 of second member 52 and within recesses 48 and 50 of first member 12. The user then applies the force 56 to first member 12 or to rod 58 which may be connected to first member 12 by the threading engagement of threaded appendage 60 and threaded portion 62. The spin tube will be freed by passing out from centerpost 24 and may be reused, along with a base plate assembly (partially shown), after repair of other components of the washing machine assembly such as bearings 26 or 36, seals 28 or 38 and the like.

While in the foregoing specification embodiments of the present invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A tool for removing a washing machine spin tube having a pair of ears on one end thereof and an internally mounted bearing comprising:

a. a first member having a first end portion and a second end portion, said second end portion of said first member including an end surface for contacting the one end of the spin tube;

b. a pair of recesses on said second end portion of said first member intended for protecting the pair of ears on the spin tube against contact with said first member;

c. a second member connected to said first member and adapted for insertion within the spin tube, said second member having an end surface intended for contacting the internally mounted bearing, said second member extending from said first member a selected distance such that said end surface of said second end portion of said first member and said end surface of said second member are capable of substantially simultaneously contacting the one end of the spin tube and the internally mounted bearing of the spin tube, respectively.

2. The tool of claim 1 in which said second member includes a flattened portion on the external surface thereof intended for accomodating the pair of ears of the spin tube.

3. The tool of claim 1 which additionally comprises a rod which is connectable to said first end portion of said first member.

4. The tool of claim 3 in which said first member and said second member are integrally formed.

5. The tool of claim 4 in which said first and second members are substantially of cylindrical configuration.

* * * * *